US008905092B2

(12) United States Patent
Sanders

(10) Patent No.: US 8,905,092 B2
(45) Date of Patent: Dec. 9, 2014

(54) GAS PUMP KEY

(76) Inventor: Jameg Sanders, Bronx, NY (US)

( * ) Notice: Subject to any disclaimer, the term of this patent is extended or adjusted under 35 U.S.C. 154(b) by 17 days.

(21) Appl. No.: 13/447,472

(22) Filed: Apr. 16, 2012

(65) Prior Publication Data

US 2013/0270469 A1 Oct. 17, 2013

(51) Int. Cl.
*B65B 1/04* (2006.01)
*G05G 5/06* (2006.01)

(52) U.S. Cl.
CPC ..... *G05G 5/06* (2013.01)
USPC ..... 141/392; 141/218; 251/90; 251/107; 248/565

(58) Field of Classification Search
USPC ..... 141/392, 218, 206; 251/90, 111, 107; 248/565
See application file for complete search history.

(56) References Cited

U.S. PATENT DOCUMENTS

| | | | | | |
|---|---|---|---|---|---|
| 1,890,423 | A | * | 12/1932 | Teagarden | 42/94 |
| 2,647,412 | A | | 8/1953 | Warmoes et al. | |
| 2,866,437 | A | | 12/1958 | Fend | |
| 2,971,283 | A | | 2/1961 | Parker | |
| 3,037,483 | A | | 6/1962 | Caviglione | |
| 3,051,131 | A | | 8/1962 | Schwarzaugl | |
| 3,288,114 | A | | 11/1966 | Ritter | |
| 3,362,201 | A | | 1/1968 | Lachin | |
| 3,695,612 | A | | 10/1972 | Barrios | |
| 3,724,961 | A | | 4/1973 | Levoin | |
| 4,098,488 | A | | 7/1978 | Forrest | |
| 4,210,181 | A | * | 7/1980 | Clevenger | 141/392 |
| 4,216,807 | A | * | 8/1980 | Diamond | 141/392 |
| 4,334,560 | A | * | 6/1982 | Lockwood | 141/392 |
| 4,337,917 | A | * | 7/1982 | Tesack et al. | 251/90 |
| 4,419,874 | A | * | 12/1983 | Brentini | 70/459 |
| 4,591,074 | A | | 5/1986 | Kennings | |
| 4,626,118 | A | | 12/1986 | Bellavance | |
| 4,846,447 | A | | 7/1989 | Hanna | |
| 5,074,694 | A | | 12/1991 | Nakazato et al. | |
| 5,752,401 | A | * | 5/1998 | MacDonald | 70/459 |
| 6,227,266 | B1 | * | 5/2001 | Moore et al. | 141/392 |
| 6,418,988 | B1 | * | 7/2002 | Palumbo et al. | 141/392 |
| D473,456 | S | | 4/2003 | Rodriguez, Jr. | |
| 6,830,086 | B2 | | 12/2004 | Smith et al. | |
| 6,837,638 | B1 | | 1/2005 | Noguchi | |
| D619,444 | S | * | 7/2010 | Oyegoke | D8/349 |
| 7,922,411 | B2 | | 4/2011 | Kageyama | |
| 2005/0191112 | A1 | | 9/2005 | Yoon | |
| 2006/0185765 | A1 | | 8/2006 | Bates, III | |
| 2009/0136283 | A1 | | 5/2009 | Diamond | |
| 2010/0294813 | A1 | | 11/2010 | Delage | |
| 2011/0116857 | A1 | | 5/2011 | Carroll et al. | |

* cited by examiner

*Primary Examiner* — Jason K Niesz
(74) *Attorney, Agent, or Firm* — Mei & Mark LLP

(57) ABSTRACT

A pressure brace device holds a gas pump handle in the open position, can store small items such as a SPEEDPASS, and can be clipped to small-gauge items such as a key ring. The pressure brace comprises a depressible plunger within a spring-loaded housing. The plunger is compressed into the housing while the brace is situated in the gas pump handle, then released. The outward pressure provided by the spring holds the handle in the open position, allowing gas to flow through the pump.

19 Claims, 6 Drawing Sheets

GAS PUMP KEY

TECHNICAL FIELD

The present disclosure relates generally to compressible pressure braces that perform their function by exerting outward pressure to push two surfaces apart. The device may be used to maintain a gas pump handle in the squeezed, gas-flowing position by pressing outward in the space between the handle itself and the protective handle guard that exists on many gas pumps.

BACKGROUND

Most gas station pumps normally include a latching mechanism that allows the pump handle to remain in the squeezed position, and thus gas to continue to flow, without the customer staying to hold the handle. In many instances, those latches are damaged or removed, and the customer must stay to hold the handle.

In an effort to amend this inconvenience, a brace can be used to maintain the squeezed position of the gas pump handle.

A prior art implementation of a mechanism to hold a gas pump handle open involved the use of a solid, single piece wedged into the gap between the handle and the handle guard. Drawbacks to this design include the potential for slippage, and a generally fixed size that does not allow the device to accommodate variations in handle grip sizes. Not only can the design be too loose when installed on handles with more space between the handle and the handle guard, the design can also be cumbersome to remove or impossible to install when used with grips with smaller spaces between the handle and the handle guard. These are generally not difficult to store, though it is suggested they be added to a key ring, increasing the "clutter."

Another prior art implementation involves clip-like devices that involve the placement of a C-shaped unit that encompasses both the handle lever and the grip in a manner similar to a person's hand. Drawbacks to this design include the potential for slippage, and a generally fixed size that does not allow the device to accommodate variations in handle grip sizes. Not only can the design be too loose when installed on smaller grips, the design can also be cumbersome to remove if installed on a larger grip. These can also be difficult to store depending on their shape, and it is suggested they be added to a key ring, increasing the "clutter."

SUMMARY

Therefore, the inventor provides an improved brace, with the ability to hold the pump handle in the open position while accommodating variations in the gap size between the handle and the handle guard.

Another object of the disclosure is to provide such a brace with improved ease of installation and removal.

Another object of the disclosure is to provide such a brace that includes ergonomic and non-slip features to keep the device in the proper position when in use.

A further object of the disclosure is to provide a brace that can be removably clipped to a key ring or other similarly-sized construct for storage when not in use. The brace is easily removed from a key ring to avoid placing the user's keys on the gas pump handle.

A further object of the disclosure is to provide a compact brace that allows storage for items, such as a SPEEDPASS, within itself, offering the ability to reduce key ring clutter. A SPEEDPASS is hardware for dispensing fuel at a service station, namely, an electronic device which can be scanned by a dispensing pump to activate the pump.

In one embodiment, a pressure brace providing the benefits described above comprises a hollow, spring-loaded housing and a depressible plunger that when compressed, may be inserted into the gap between the squeezed handle of a gas pump and the handle guard. Compression is achieved by the user pressing a tab that extends from the outer end of the plunger, forcing the plunger into the housing. When the compression is released, the spring's outward force is sufficient to keep the gas pump handle in the squeezed position, allowing gas to flow without a person holding the handle. The pressure brace may include features such as a latch that allows for it to be clipped to a key ring or the like, or an end cap that may be removed or opened to allow things to be stored within the hollow housing.

Various embodiments of this mechanism may employ either additional inserts or features intrinsic to the parts to ensure alignment and positioning of moving parts. The end cap may employ screw-on or latching methods for removal and replacement.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

FIG. 5A shows a view of the end of the housing from cross-section Y-Y, where an end cap may be pressed on.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

DETAILED DESCRIPTION

Reference will now be made in detail to the present exemplary embodiments, examples of which are illustrated in the accompanying drawings. Wherever possible, the same reference numbers will be used throughout the drawings to refer to the same or like parts.

Figure 1:
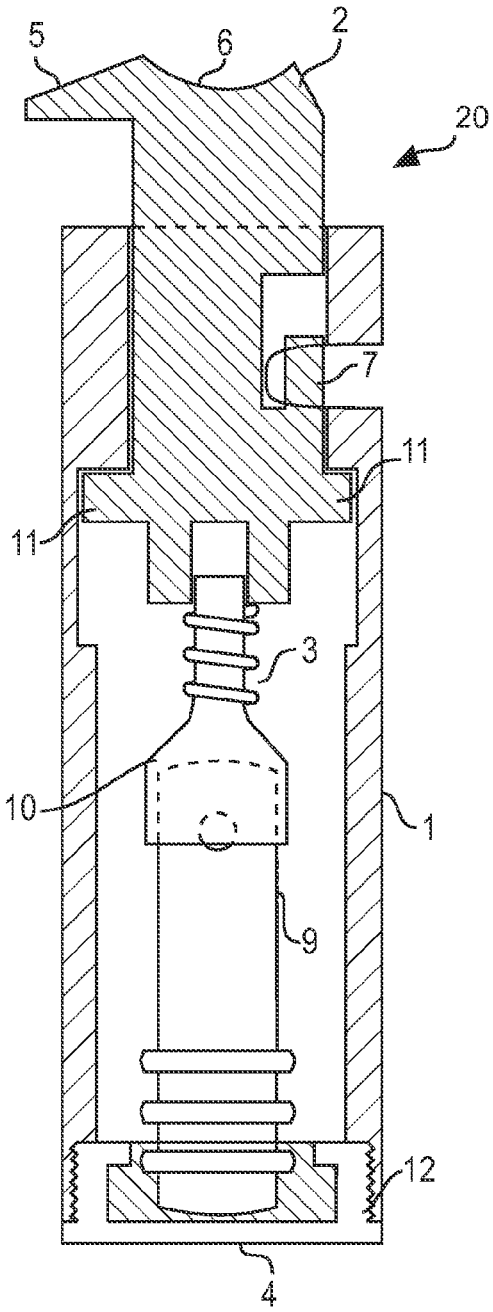
FIG. 1 shows an exemplary pressure brace, with the depressible plunger in the fully extended, at-rest position, with the latch closed.

FIG. 1 shows an exemplary pressure brace 20, with the depressible plunger 2 in the fully extended, at-rest position, with the latch closed. The pressure brace 20 is composed of a hollow housing 1 with a cut-out notch 8. One end of the housing is closed by a removable end cap 4. The housing 1 includes threading 12 at this end to allow the end cap 4 to be screwed in, the end cap 4 having mating threading.

The end cap 4 both provides access to the interior of the assembly, and presents a base to support a cylindrical prop (not shown) or SPEEDPASS 9. That is, pressure brace can be sold with the prop, or "dummy" piece, that can be replaced by an end user with a SPEEDPASS 9. This reduces key ring clutter by combining two space-using articles into one. The prop or SPEEDPASS 9 can rest against or within a stand 10. That is, the stand 10 can have a smooth bottom surface or a recess into which the prop or SPEEDPASS 9 can fit. A spring 3 can be mounted around an upper cylindrical portion of the stand 10 and the spring 3 can be retained between a circumferential base on the stand 10 and a bottom surface of the depressible plunger 2.

Figure 7:
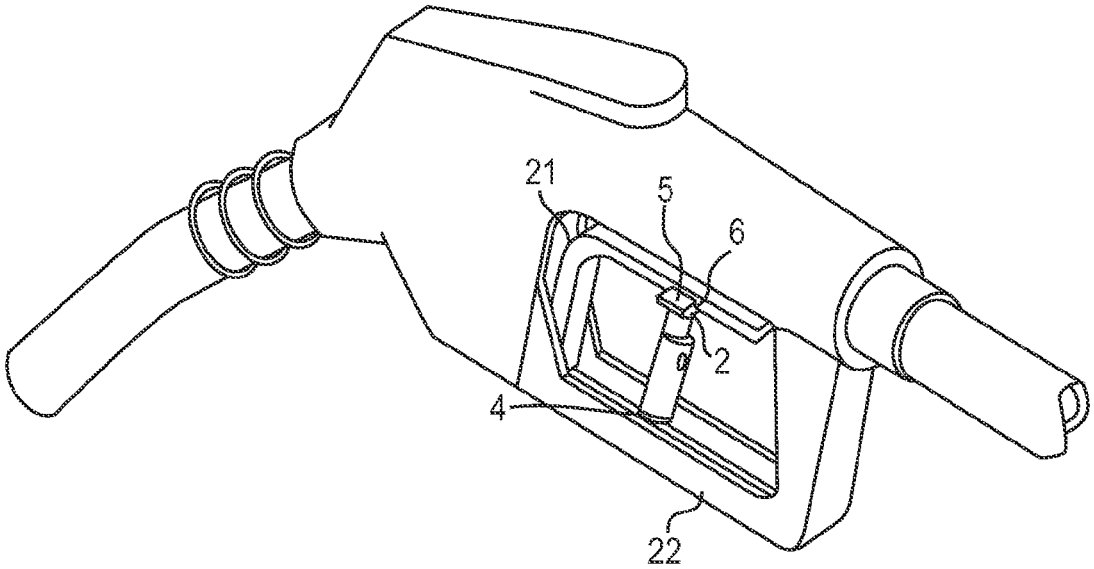
FIG. 7 shows the device installed in an exemplary gas pump handle.

The interior end of the depressible plunger 2 comprises includes a distal projection 7. The projection 7 extends out from the bottom and parallel to the long axis of the plunger 2. In this position, the function of the projection 7 is to span across at least a portion the notch 8 in a manner of a closed latch, which may be used to secure the device to a key ring or other small-diameter object. The spring 3 exerts a sufficient outward force to maintain this position. In the event that the spring 3 is not strong enough to maintain the gas pump handle 21 in the squeezed condition, the pressure brace 20 can be rotated so that the extended tab 5 rests against the gas pump handle 21, as shown in FIG. 7. The pressure brace 20 can also be rotated so that the extended tab 5 extends parallel to the gas pump handle 21 in the opposite direction as shown in FIG. 7.

Figure 2:
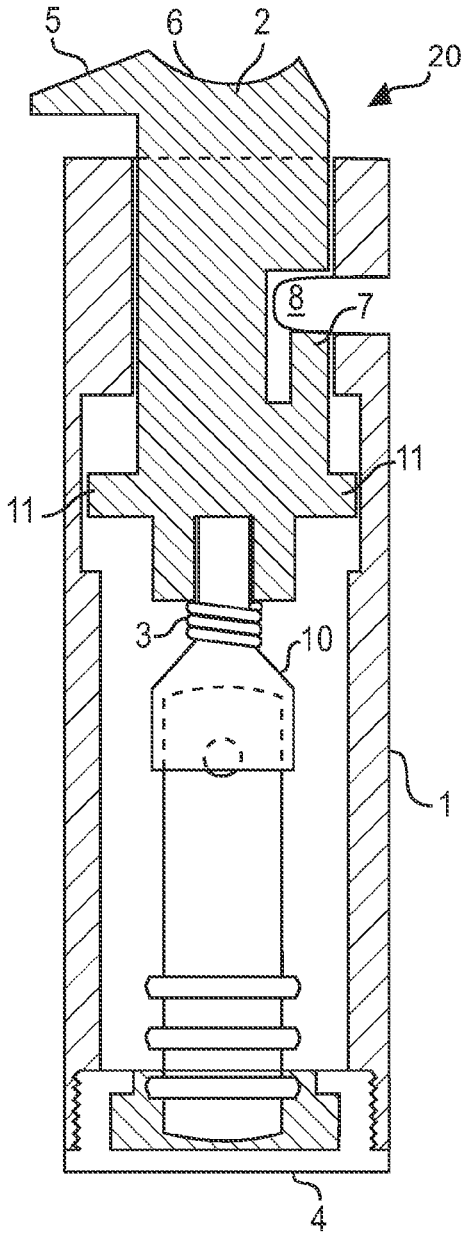
FIG. 2 shows the plunger fully depressed, and the latch open.

FIG. 2 shows the device in a fully-compressed position. In this position, the pressure brace may be placed into the space between a gas pump handle 21 and the handle guard 22; or, replaced on a keychain. To achieve the fully-compressed state, the outer end of the depressible plunger 2 has an extended tab 5. Exerting pressure on the tab 5 forces the depressible plunger 2 into the housing 1, compressing the spring 3. Some of the cylindrical portion of the stand 10 enters in to a recess in the depressible plunger 2. The spring 3 does not enter the recess, but remains compressed against the bottom surface of the depressible plunger 2 and the circumferential base of the stand 10. The pressure brace is prepared for installation, and the projection 7 is moved from its position across the housing notch 8 to a position inside the housing 1, leaving the notch 8 unimpeded and thus the latch open.

When the pressure brace device 20 is in use and installed in a gas pump handle, as shown in FIG. 7, the capped end 4 is rested against the pump handle guard 22, and the inward pressure on the tab 5 is released. The spring 3 exerts an outward pressure on the depressible plunger 2 supporting the handle 21 of the gas pump in the squeezed position. An ergonomic dimple 6 is present to provide a groove into which the gas pump handle 21 can rest, and reduce the likelihood of the device slipping laterally out of a useful position. The tab 5 is located off the central axis of the device to make installation/removal easier and to ensure proper placement, as the device achieves maximal outward pressure during use if the pump handle guard 22, end cap 4, plunger 2, dimple 6, and the handle 21 of the gas pump are aligned on the same axis. Depending on the distance between the gas pump handle 21 and the handle guard 22, the pressure brace's installed configuration may resemble either FIG. 1 or FIG. 2, or some position in between. An optional rubber coating may be present on one or more of the perimeter of the end cap 4, portions of the bottom surface of the end cap 4, and in the dimple 6.

Instead of extending perpendicular to the long axis of the gas pump handle 21, and as mentioned above, the pressure brace may be rotated so that the long axis of the extended tab 5 rests against the long axis of the gas pump handle 21.

Figure 3A:
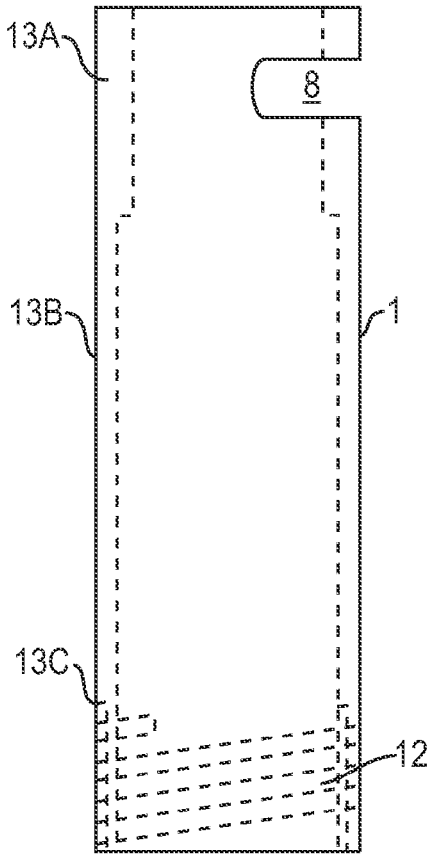
FIG. 3A is a cross-sectional view of the housing showing the internal walls.
Figure 3B:
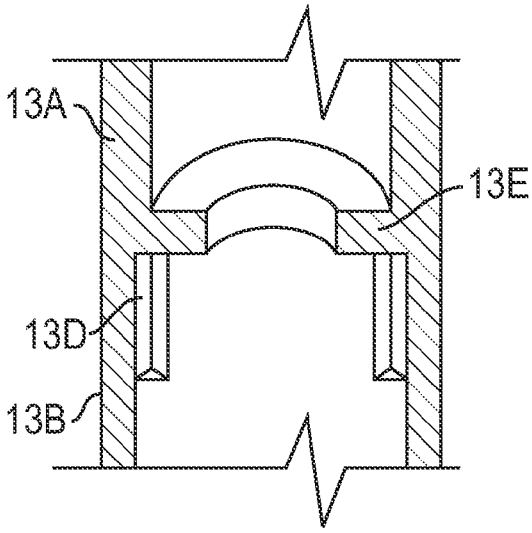
FIG. 3B is an alternative cross-sectional view of the housing showing vertical grooves in the internal walls.
Figure 3C:
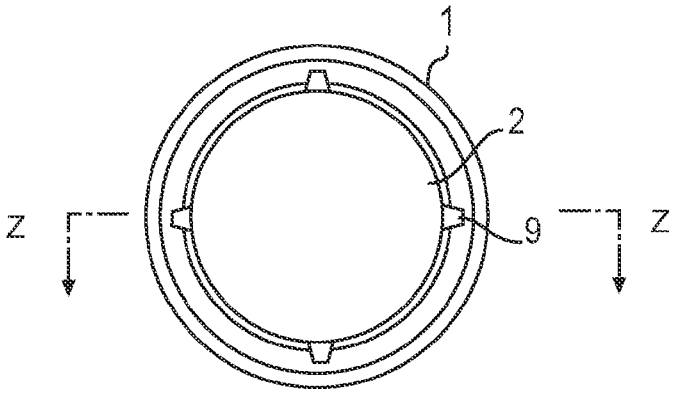
FIG. 3C shows a view into the top of the housing from cross-section Z-Z, where the depressible plunger may be located using tongue and groove pairings.

FIGS. 3A, 3B, and 3C show alternative interiors of the housing 1, where the depressible plunger 2 interfaces with the housing 1. FIG. 3A shows a vertically stepped interior with lower threading 12. The interior stepping can vary to accommodate circumferential variations in the internal parts and can be tailored to help brace the interior parts. For instance, the upper end wall section 13A is thicker than the middle interior wall 13B so that stays 11 on the depressible plunger 2 can catch against a lip 13E formed at the meeting point of the upper interior wall 13A and the middle interior wall 13B. The stays 11, which can span the circumference of the depressible plunger 2, or which can be diametrically opposed projections, prevent the depressible plunger 2 from falling out of the housing.

FIG. 3B shows vertical grooves 13D for vertical travel of diametrically opposed stays 11. A circumferential lip 13E further assists with the placement of the stays 11 and the circumferential lip 13E can alternatively be used without the vertical grooves 13D. The stays 11 can be rounded on a lower edge to assist with smooth insertion for manufacturing purposes. An upper surface of stays 11 can be rectilinear to prevent removal.

FIG. 3A also shows a lip formed between middle interior wall 13B and lower interior wall 13C. The lip provides a stop for end cap 4. Other lips may be formed in the interior walls of the housing 1 for like bracing and positioning functions for the remaining housed parts and surfaces. For instance, as shown in FIG. 3C, tongue and groove parings are shown for the depressible plunger 2 and housing 1, though the tongues and grooves can be reversed. The tongue-and-grooves maintain the orientation of the plunger 2 such that the projection 7 and housing notch 8 are aligned so that they can perform their latching function. Additional features keep the plunger 2 from falling out of its end of the housing 1.

Figure 4A:
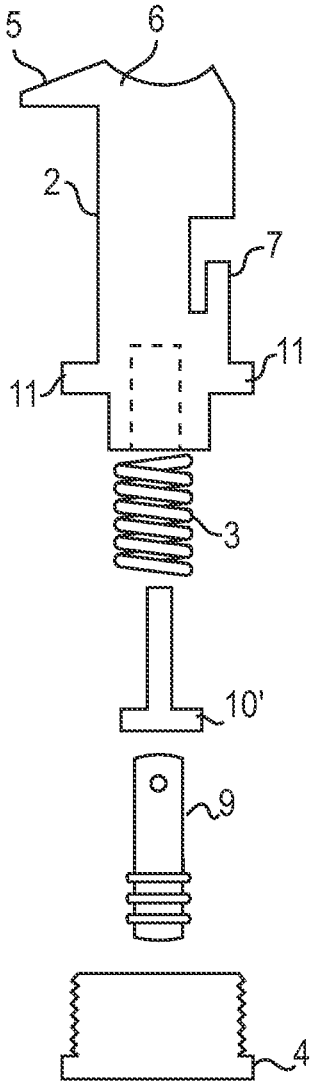
FIG. 4A is an expanded view of the internal components of the brace.
Figure 4B:
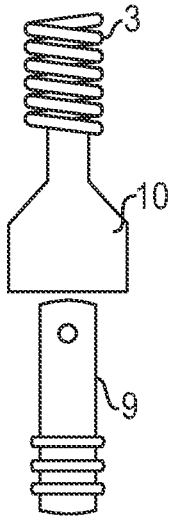
FIG. 4B is an alternative embodiment of an expanded view of the internal components of the brace.

FIGS. 4A and 4B show alternative exploded views of several internal elements. FIG. 4A shows hollow end cap 4 with a lower rubber coating that covers the lower perimeter and the bottom surface. A SPEEDPASS 9 is housed in the end cap 4. A stand 10' has a smooth bottom surface, a flattened circumferential base and an upper cylindrical portion. A spring 3 coils around the upper cylindrical portion and the spring 3 rests against a bottom surface of the depressible plunger 2.

FIG. 4B shows an alternative stand 10 in combination with a spring 3 and SPEEDPASS 9. The stand 10 has a recess in the bottom surface that accommodates an upper portion of a prop or SPEEDPASS 9. The recess stabilizes the prop or SPEEDPASS 9. The base of the stand tapers upward to the upper cylindrical portion.

Figure 5A:
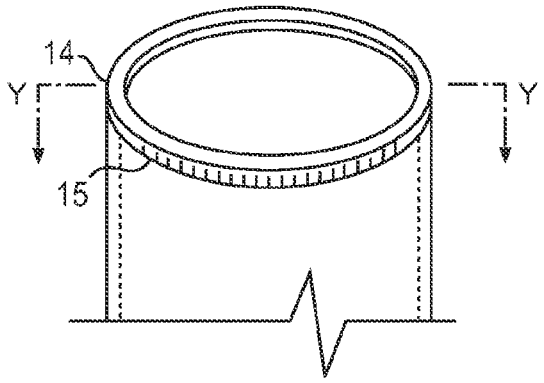
Figure 5B:
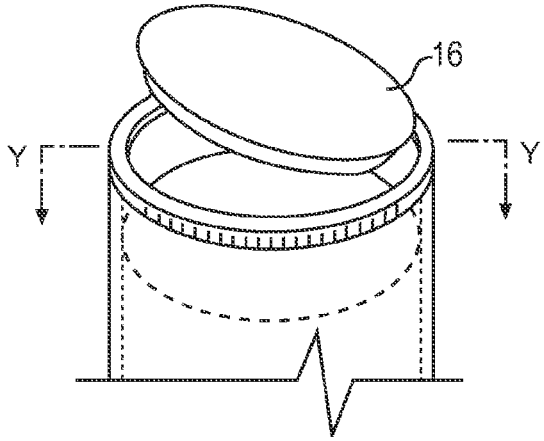
FIG. 5B shows an alternate view of the end cap from cross-section Y-Y, with the end cap opened.

FIGS. 5A and 5B show alternate views with a flat end cap 14 that can be opened without unscrewing the entire end. An internally extending portion 15 of the flat end cap 14 can extend upward to provide a base against which the stand 10 or spring 3 presses. A removable piece 16 opens and closes using a thumb catch to allow the storage of a SPEEDPASS or other small items. The removable piece 16 can be clear so that the user can see what item may be stored inside. Likewise, at least a bottom window portion of end cap 4 may be made of a transparent material, or the end cap 4 may be made entirely of a transparent material.

Figure 6:
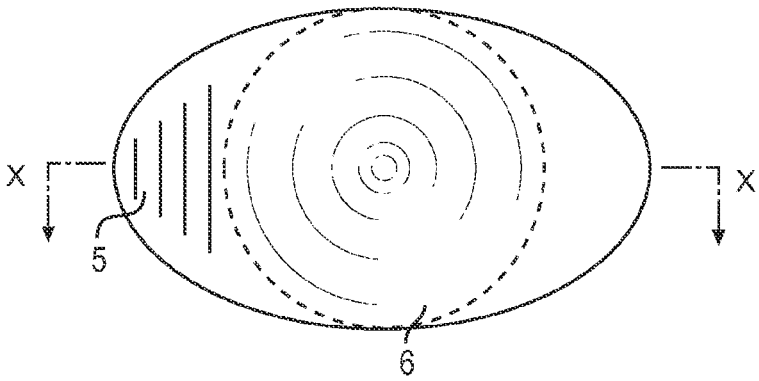
FIG. 6 shows a view of the uppermost end of the depressible plunger from cross-section X-X.

FIG. 6 is a view looking in at the uppermost end of the depressible plunger 2. This may take many shapes and sizes other than the oval shown, but should include the extended tab 5 and ergonomic dimple 6. These may include ridges as depicted in the drawing, which would serve to improve the user's grip when pressing the tab 5 to operate the device, and increase the friction between the plunger 2 and the gas pump handle 21.

Figure 8:
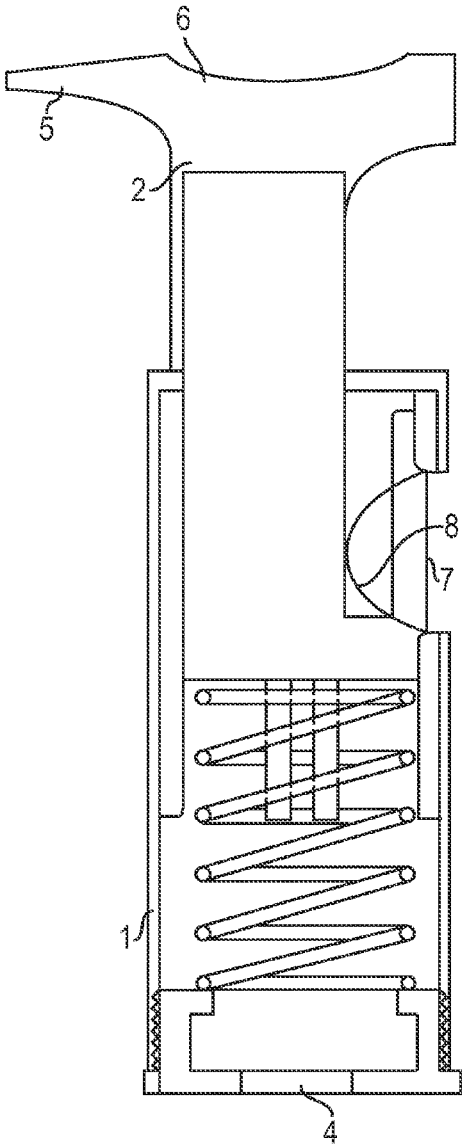
FIG. 8 is a view of an alternative embodiment of the plunger in the installed or latched condition.
Figure 9:
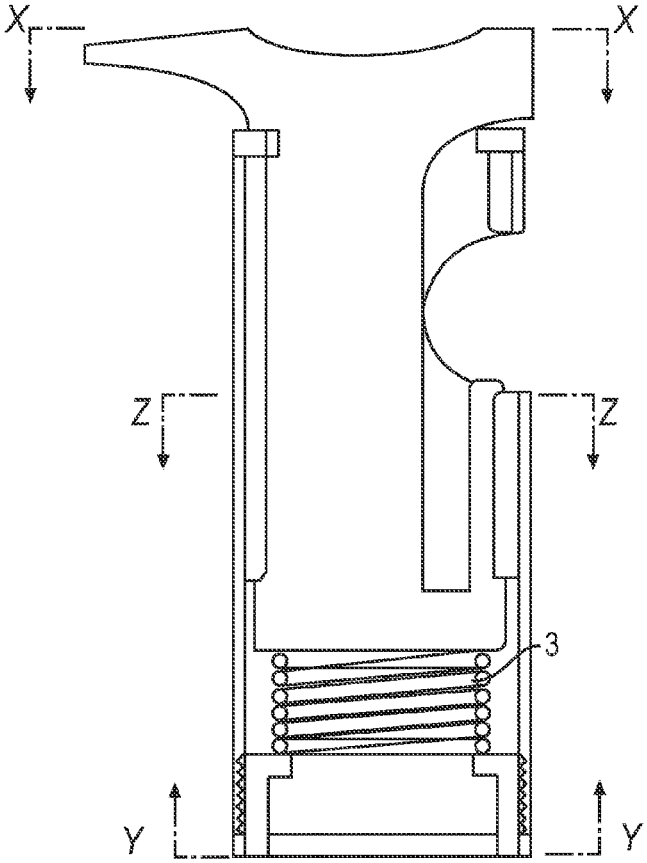
FIG. 9 is a view of the alternative embodiment of FIG. 8 in the depressed, installable, or unlatched condition.

FIGS. 8 and 9 show another alternative embodiment having a simplified interior structure. The end cap 4 functions as a base for the spring 3. A tongue and groove configuration guides the depressible plunger 2 in the housing 1. Yet another alternative is to form interior lips in the housing 1 to support the spring 3.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

For instance, the interior of housing 1 and the exterior of plunger 2 may be of a hexagonal or other polygonal shape, rather than cylindrical, thereby maintaining relative alignment without tongue-and-groove features. The end caps 4, 14 may also be convex, or coated with a soft material to improve the contact between the pressure brace and the handle guard when in an installed position. The end cap's 4 function as a base for the spring 3 may be accomplished with indentations formed by compressing the housing 1 in appropriate locations, causing protrusions inside the housing 1 against which the spring 3 can press. As another example, the end cap 4 can be permanently affixed to the housing 1, or even integrally formed with the housing 1. And, in addition to or as an alternative to storing a SPEEDPASS, the pressure brace can be used to store items such as medications, and the end cap can be formed as a screw-in or press-in airtight container to facilitate the preservation of the medication.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. A pressure brace adapted to brace a handle of a gas pump, comprising:

a cylindrical, hollow housing comprising an upper end, an upper notch adjacent the upper end, and a lower receptacle;

a depressible plunger extending from the upper end of the housing and slidable within the housing, the depressible plunger comprising a groove and a pressable tab on a first end and further comprising a projection between the first end and a second end of the plunger;

an end cap removably coupled in to the lower receptacle;

a prop between the end cap and the depressible plunger; and a spring within the housing biased between the prop and the plunger to push the depressible plunger outward from the housing, wherein:

when the plunger is depressed, the spring is compressed against the prop, and the projection and the notch form an open latching mechanism, and when the plunger is not depressed, the projection forms a closed latching mechanism.

2. The pressure brace of claim 1, wherein the depressible plunger maintains the alignment of the latching mechanism by a tongue on the depressible plunger that aligns with at least one groove provided on the interior of the housing.

3. The pressure brace of claim 1, wherein:

the interior housing walls comprise at least one lip;

the depressible plunger comprises a projecting stay; and the depressible plunger maintains its placement within the housing by abutting the projecting stay against the at least one lip.

4. The pressure brace of claim 1, wherein the sizing and alignment of the projection of the depressible plunger and the housing notch are configured to selectively engage and disengage a key ring.

5. The pressure brace of claim 1, wherein the end cap is configured to removably store items within the housing.

6. The pressure brace of claim 1, wherein the groove is an ergonomic dimple such that the dimple aligns with a curvature of a gas pump handle squeeze grip when the pressure brace is installed against a gas pump handle.

7. The pressure brace of claim 1, wherein the housing further comprises a removable insert between the end cap and the prop.

8. The pressure brace of claim 1, wherein the prop is a circumferential stand.

9. The pressure brace of claim 8, wherein the prop comprises a conical or cylindrical extension and the spring surrounds at least a portion of the conical or cylindrical extension.

10. A pill case pressure brace adapted to brace a handle of a gas pump, comprising:

a cylindrical, hollow housing comprising a plurality of interior surfaces;

a depressible plunger extending from a first end of the housing, the depressible plunger comprising at least one projecting stay;

a removable end cap within a second, opposite end of the housing, the end cap comprising a pill storage space and a circumferential lip; and a spring within the housing between the circumferential lip and the plunger, the spring configured to push the depressible plunger outward, wherein:

at least a portion of the plurality of the interior surfaces form a lip, and the at least one projecting stay is configured to selectively push against the lip, and the at least one projecting stay is configured to travel away from the lip when the depressible plunger is pressed.

11. The pill case pressure brace of claim 10, wherein the housing further comprises a notch, and wherein the notch and the projecting stay cooperate to provide a keychain attachment mechanism.

12. The pill case pressure brace of claim 10, wherein the housing has a notch and the depressible plunger has a projection, wherein the projection is movable with respect to the notch so as to block and unblock at least a portion of the notch.

13. The pill case pressure brace of claim 10, wherein the end cap comprises a transparent material.

14. The pill case pressure brace of claim 10, wherein at least a portion of the end cap couples to the opposite end of the housing by way of threading.

15. The pressure brace of claim 1, wherein the end cap comprises a transparent material.

16. The pressure brace of claim 1, wherein at least a portion of the end cap couples in to the lower receptacle of the housing by way of threading.

17. The pressure brace of claim 1, further comprising a storage space between the prop and the end cap.

18. The pressure brace of claim 1, wherein the end cap comprises a thumb catch.

19. The pill case pressure brace of claim 10, wherein the end cap comprises a thumb catch.

* * * * *